US006759939B2

(12) United States Patent
Sudan et al.

(10) Patent No.: US 6,759,939 B2
(45) Date of Patent: Jul. 6, 2004

(54) FUSE HOLDER ASSEMBLY

(75) Inventors: Madhu Sudan, Bangalore (IN); Javier Gomez Martin, Madrid (ES); Jorge Vallejo, Madrid (ES); Anilkumar Dinker Pandit, Bangalore (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/063,475

(22) Filed: Apr. 26, 2002

(65) Prior Publication Data

US 2003/0201867 A1 Oct. 30, 2003

(51) Int. Cl.[7] ..... H01H 85/20; H01H 85/22

(52) U.S. Cl. ..... 337/211; 337/208; 337/209; 337/284

(58) Field of Search ..... 337/186–189, 337/208–211, 216, 283, 284; 29/623

(56) References Cited

U.S. PATENT DOCUMENTS 2,313,364 A * 3/1943 Schultz ..... 337/195
2,938,093 A * 5/1960 McCloud ..... 337/187
3,030,474 A * 4/1962 Scott, Jr. ..... 337/7
3,379,842 A * 4/1968 Downs et al. ..... 337/146
3,732,516 A * 5/1973 Puetz ..... 337/194
4,178,061 A * 12/1979 Ahroni ..... 439/622
4,559,504 A * 12/1985 Krec ..... 337/194
5,076,118 A * 12/1991 Lawson ..... 81/3.8
5,559,662 A * 9/1996 Happ et al. ..... 361/104
5,963,411 A * 10/1999 Mollet et al. ..... 361/104
5,969,587 A * 10/1999 Combas ..... 335/132
6,459,353 B1 * 10/2002 Mattlar et al. ..... 337/9

* cited by examiner

*Primary Examiner*—Anatoly Vortman
(74) *Attorney, Agent, or Firm*—Cantor Colburn LLP

(57) ABSTRACT

A fuse holder comprising: a housing defining an enclosed region, the housing comprises a base and a cover, the base and cover adapted to accept differently configured cage holders within the enclosed region; a pair of contacts within the housing at opposite ends of the enclosed region and spaced to engage terminals on ends of a fuse; and a first cage holder and second cage holder configured to fit within in the housing, each cage holder of the first and second cage holders includes either a single pole cage or a plurality of pole cages.

10 Claims, 5 Drawing Sheets

FUSE HOLDER ASSEMBLY

BACKGROUND OF INVENTION

A fuse holder includes a fuse carrier or fuse-carrier unit mounted to a receptacle or receptacle unit. In use, a fuse carrier bears an elongated fuse which has a pair of terminals. The fuse carrier releasably disposes the terminals for each fuse in tight electrical engagement with companion contacts of the receptacle.

The fuse carrier commonly comprises a body of molded insulation and the receptacle has a base and a complementary cover, both of molded insulation. In use, fuse receptacles are fixed in place, as on a panel. The fuse carrier is pivotally joined to the receptacle.

The pivotally joined carrier incorporates manual force-multiplied means for driving the fuse-carrier outward for releasing the tight grip of the contacts on the fuse terminals. More specifically, the force-multiplying means in the described fuse holder is a lever pivoted at one end of the fuse holder and acting against the other end of the fuse holder. Once the carrier is pivoted outward, the fuse may be removed and replaced. Typically, each fuse holder contains one fuse, being a single-pole device for interrupting a single current path.

A common form of circuit connection to the receptacle contacts of a fuse holder is by wires that enter the receptacle, joined to the receptacle contacts by screw-actuated wire fasteners.

Presently, two types of fuse holders are needed for a single pole circuit with a neutral line and a single pole circuit without a neutral line due to the different number of connections in each case. The difference in the number of receptacle connections necessitates two different bases and covers for the fuse holder.

SUMMARY OF INVENTION

The above discussed and other drawbacks and deficiencies are overcome or alleviated by a fuse holder comprising: a housing defining an enclosed region, the housing comprises a base and a cover, the base and cover adapted to accept differently configured cage holders within the enclosed region; a pair of contacts within the housing at opposite ends of the enclosed region and spaced to engage terminals on ends of a fuse; and a first cage holder and second cage holder configured to fit within in the housing, each cage holder of the first and second cage holders includes either a single pole cage or a plurality of pole cages.

BRIEF DESCRIPTION OF DRAWINGS

Referring now to the drawings wherein like elements are numbered alike in the several Figures.

DETAILED DESCRIPTION

Figure 1:
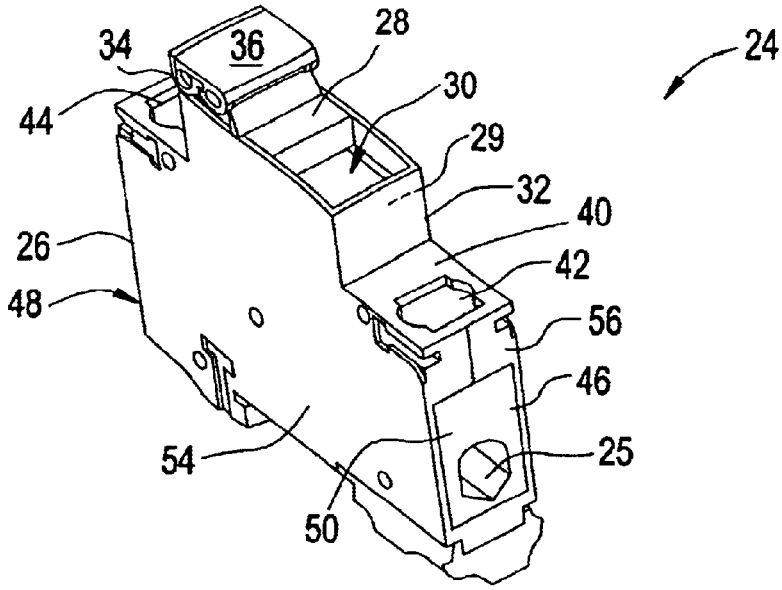
FIG. 1 is a perspective view of an assembled single pole fuse holder.
Figure 2:
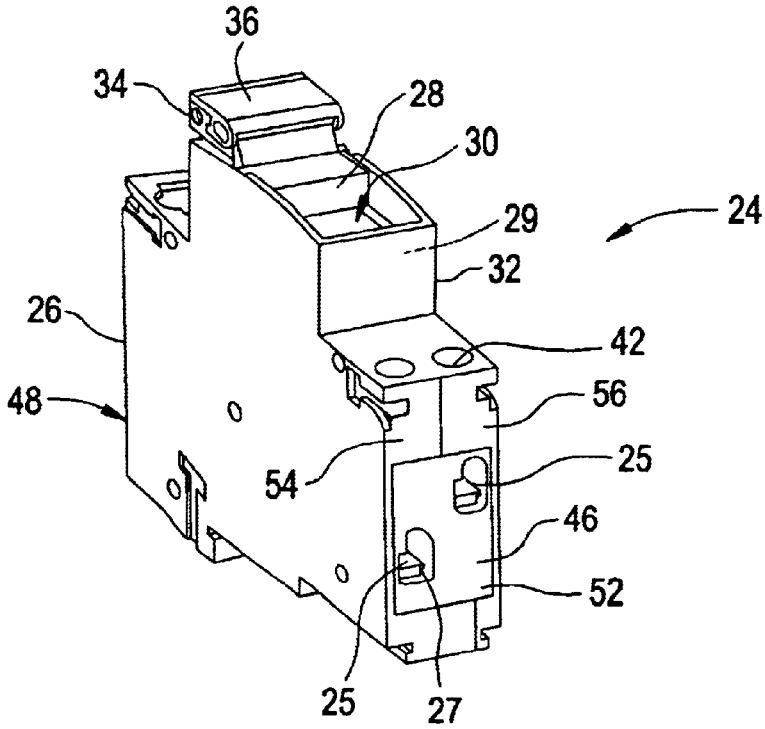
FIG. 2 is a perspective view of an assembled single pole fuse holder having a neutral connector.

Referring to FIGS. 1 and 2, there is shown a fuse holder 24 including a housing 26 and a fuse carrier 28. Housing 26 includes a base 54 and a cover 56 that are adapted to retain a single pole cage holder 50 (FIG. 1) or a two-pole cage holder 52 (FIG. 2). In FIG. 1, housing 26 retains a cage holder 50 that has a single terminal 25 for accepting a wire (not shown) from a phase of a power distribution circuit (not shown). FIG. 2 depicts housing 26 retaining a cage holder 52 having a phase terminal 25 and a neutral terminal 27. Terminal 25 accepts a wire (not shown) from a phase of a power distribution circuit (not shown) and the terminal 27 accepts a neutral wire from the power distribution circuit.

Base 54 and cover 56 of housing 26 define an enclosed region 29 there between and an opening 30 to region 29 in a side extension 32 of housing 26. Fuse carrier 28 is pivotally mounted on housing 26 and is movable between a closed position (shown in FIGS. 1 and 2), and an open position (FIG. 8), in which a fuse can be inserted into carrier 28. Fuse carrier 28 includes a lever 34 for pivotally opening and closing carrier 28 relative to housing 26. A circuit indicator tag 36 is optionally disposed on lever 34 to identify the fuse rating of a fuse enclosed within housing 26. On a top surface 40 of housing 26 are two apertures 42, 44 which allow a portion of cage holder 50, or 52 to extend therethrough. Housing 26 also includes a first opening 46 and a second opening 48 disposed at opposite ends of fuse holder 24 and extending in planes generally perpendicularly oriented relative to a top surface 40. A portion of cage holder 50 or 52 extends through first and second openings 46 and 48.

Figure 3:
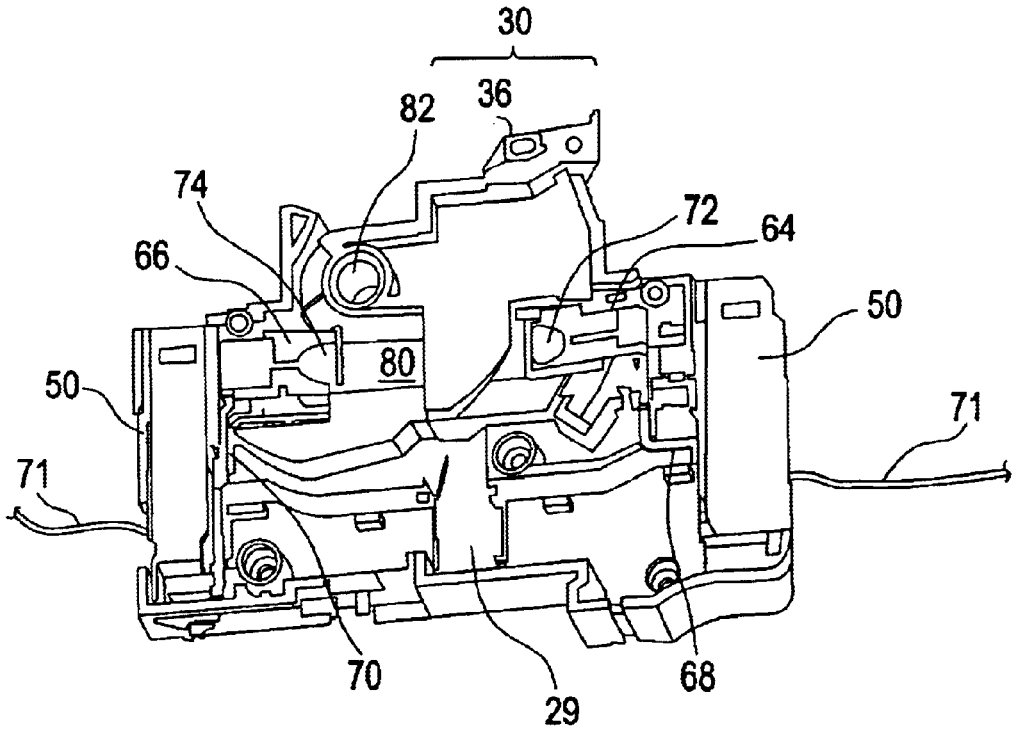
FIG. 3 is a perspective view of the fuse holder of FIG. 1 without a cover.

Referring to FIG. 3, fuse holder 24 is shown absent cover 56. Within enclosed region 29 of housing 26 are a pair of U-shaped contacts 64, 66 at opposite ends of the enclosed region 29 and spaced to engage end cap terminals 72, 74 on the ends of a fuse 80 when fuse 80 is moved within enclosed region 29. Fuse carrier 28 is pivotally mounted on housing 26 via a pin (not shown) extending through an aperture 82 formed in fuse carrier 28. Fuse carrier 28 is movable between a closed position (shown in FIG. 3), in which contacts 64, 66 electrically engage end cap terminals 72, 74. Contacts 64, 66 are connected to terminals 68, 70, respectively. Terminals 68, 70 are in turn received within cage holders 50 and are in electrical communication with electrical wires 71, which are also received within cage holders 50.

Figure 4:
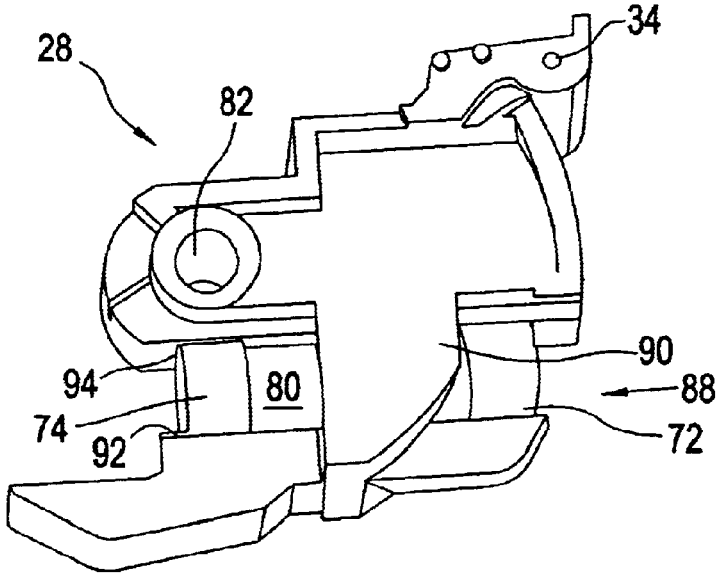
FIG. 4 is a perspective view of a fuse carrier and fuse removed from a fuse holder.

Referring to FIG. 4, fuse carrier 28 defines fuse insertion region 88. Fuse carrier 28 further includes an aperture 90 configured to slidably receive end cap terminal 74 when fuse 80 is inserted in fuse insertion region 88. Fuse carrier 28 has shoulders 92, 94 at the lower end of region 88 to prevent further translation of fuse 80 through aperture 90. The outside diameter of end cap terminal 74 rests against shoulders 92, 94. As is best shown with reference to FIGS. 3 and 4, end cap terminal 72 fits within the other end of fuse insertion region 88 to allow fuse carrier to pivot to a closed position without having end cap terminal contacting side extension 32 that forms opening 30 (FIG. 3). Opening 30 to housing 26 is sized to permit closure of carrier 28 with fuse 80 carried therein.

Figure 5:
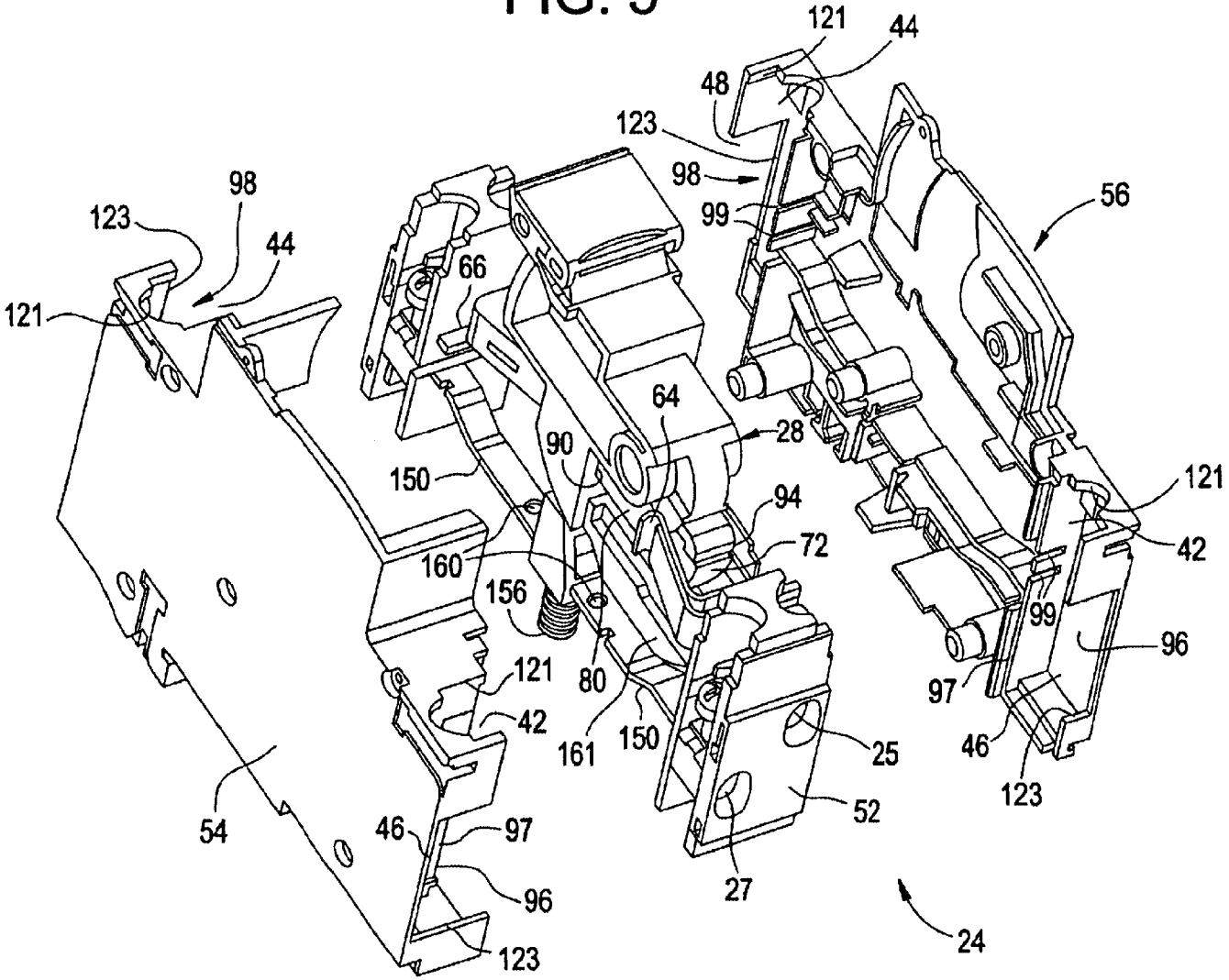
FIG. 5 is a partially exploded view of the fuse holder shown in FIG. 2.

Referring to FIG. 5, an exploded view of fuse holder 24 with two pole cage holders 52 is illustrated. Cover 56 and base 54 are separated to reveal the interaction of fuse carrier 28 with cage holder 52. Cover 56 and base 54 are configured to form a first cavity 96 and a second cavity 98. Cavities 96, 98 are disposed at opposite ends of region 29, and each cavity 96, 98 is configured to receive either cage holder 50 or cage holder 52. In this manner, the same cover 56 and base 54 can be used for different cage holders 50, 52. Two inside edges 97 depending from housing 26 and disposed in region 29 define cavities 96, 98. Each edge 97 has slots 99 formed therein to receive terminals 68, 70 and allow electrical communication between single pole terminal 25 and neutral connection terminal 27 within cage holder 52 disposed at either end of fuse holder 24.

Figure 6:
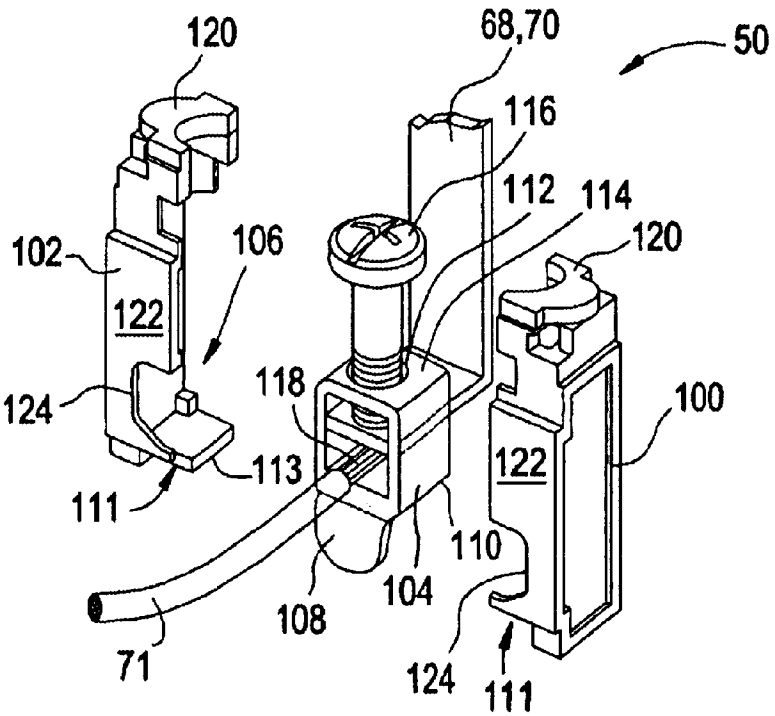
FIG. 6 is a perspective view of an exemplary cage holder used in the fuse holder shown in FIGS. 1 and 3.

Referring to FIG. 6, cage holder 50 for use with a single pole without a neutral connection is illustrated. Cage holder 50 comprises a first half section 100 and a complementary second half section 102. Both sections 100, 102 are configured to receivably retain a cage 104 within an interior portion 106 of cage holder 50. Cage 104 is stamped from an electrically conductive material, such as copper, aluminum, or the like. Cage 104 includes a flange 108 extending generally perpendicular from a bottom side 110 of cage 104. Flange 108 prevents rotation of cage 104 when cage 104 is disposed within interior portion 106 of cage holder 50. More specifically, flange 108 extends through a forward facing slot 111 formed in a bottom surface 113 of cage holder 50. In this way, bottom side 110 of cage 104 rests on bottom surface 113 of cage holder 50. Cage 104 further includes a threaded opening 112 at a top side 114 for threadably receiving a screw 116. An electrical wire (i.e., wire 71 in FIG. 3) is received in an enclosed area 118 defined by cage 104 and retained therein when screw 116 is tightened against terminals 68, 70 extending in cage 104 to retain wire 71 by clamping wire 71 between terminal 68, 70 and bottom side 110 of cage 104.

Referring to FIGS. 5 and 6, cage holder 50 includes a top surface 120 configured to fit within edges 121 defining apertures 42, 44. Top surface 120 includes an opening for access to screw 116 for operatively turning screw 116 with a tool, such as a screwdriver. Cage holder 50 further comprises a front face 122 configured to fill openings 46, 48, while providing a generally flush surface mount between housing 26 and front face 122. Front face 122 includes a cutout 124 aligned with enclosed area 118 of cage 104 to allow connection of wire 71 with cage 104.

Figure 7:
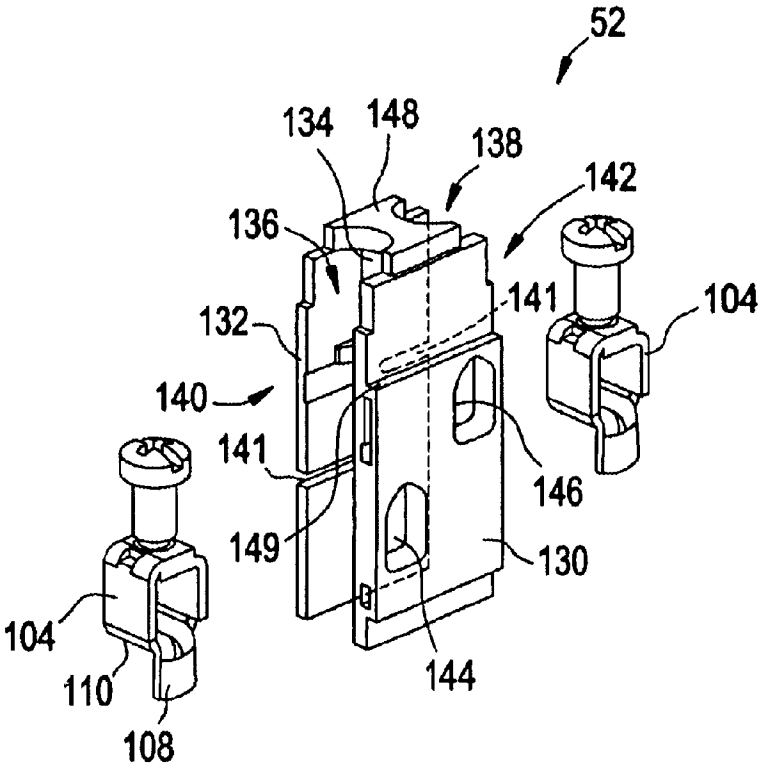
FIG. 7 is a perspective view of another exemplary cage holder used in the fuse holder shown in FIGS. 2 and 5.

Referring to FIG. 7, cage holder 52 for use with a single pole including a neutral connection is illustrated. Cage holder 52 has a front face 130, a rear face 132 and a dividing face 134 disposed intermediate faces 130, 132 and generally extending perpendicularly therebetween. Dividing face 134 and front and rear faces 130, 132 define a first cavity 136 and a second cavity 138 within cage holder 52. One cage 104 is received in cavity 136 for a neutral connection by disposing cage 104 in between front face 130 and rear face 132 from a first side 140 of cage holder 52. A slot 141 is disposed on rear face 132 and aligned with one cage 104 to provide access for a neutral strap terminal (not shown) to one cage 104. Another cage 104 is received between front face 130 and rear face 132 from a second side 142 of cage holder 52. Another slot 141 (shown in phantom) is disposed on rear face 132 and aligned with cage 104 in cavity 138 to provide access for terminals 68, 70. Front face 130 includes a cutout 144 aligned with one cage 104 received in first cavity 136 and a cutout 146 aligned with another cage 104 received in second cavity 138.

Referring to FIGS. 5 and 6, cage holder 52 further comprises a top surface 148 configured to fit within edges 121 defining apertures 42, 44 formed in housing 26. Top surface 148 is configured to divide each aperture 42, 44 to provide two openings in each aperture 42, 44 coinciding with cavities 136, 138 to allow access to screw 116 of each cage 104 disposed in each cavity 136, 138. Likewise, front face 130 is defined by a front face edge 149 configured to fit within edges 123 defining openings 46, 48. Front face edge 149 offers a generally flush surface mount between housing 26 and front face 130.

Figure 8:
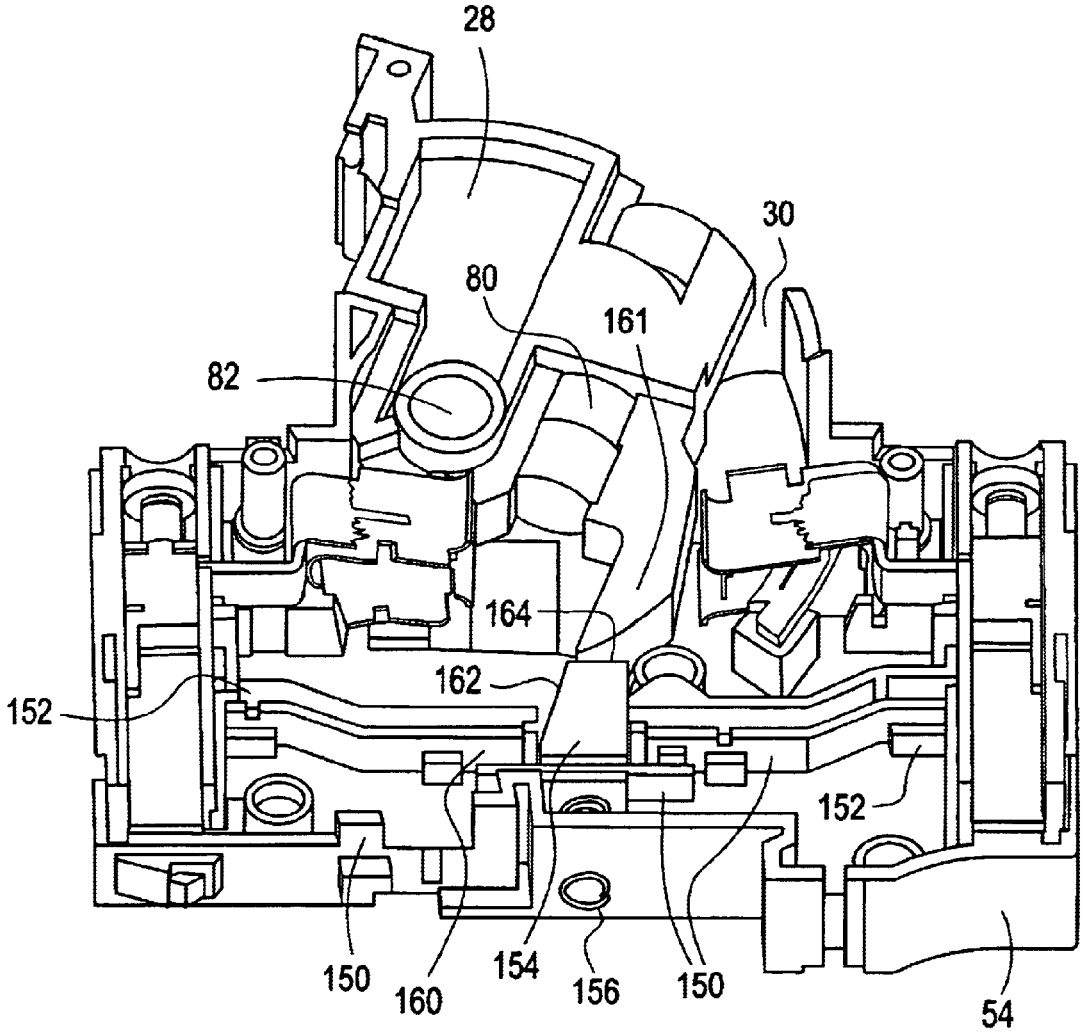
FIG. 8 is a perspective of a fuse holder shown in FIGS. 2 and 5 in an open position detailing a neutral connection.

Referring to FIGS. 5 and 8, a description of fuse holder 24 having neutral connection terminal 27 follows. Neutral connection terminal 27 includes a pair of neutral straps 150 disposed between two pairs of raised ribs 152 configured in base 54 defining a channel between each of the two pairs raised ribs 152 in which a neutral strap 150 is disposed. An angled block 154 is disposed intermediate straps 150 separating one pair of raised ribs 152 from the other pair of ribs 152. Block 154 is biased towards opening 30 by a spring 156 and is guided by ribs 152. One end of spring 156 depends from base 54 while another end of spring 156 depends from a bottom surface includes a conducting plate 158 positioned to provide electrical connection between neutral straps 150 when block 154 is moved towards opening 30. Each neutral strap 150 includes a protrusion 160 pointing downward towards conducting plate 158 to make the electrical connection between neutral straps 150 and plate 158.

FIG. 8 illustrates fuse holder 24 with block 154 in the open position, thus breaking the electrical connection between neutral straps 150. When fuse carrier 28 is pivoted about aperture 82 in a counterclockwise direction, an arm 161 depending from fuse carrier 28 contacts an angled surface 162 of angled block 154. Further counterclockwise pivoting of fuse carrier 28 forces the block 154 downward, thereby breaking the electrical connection between a top surface of plate 158 and protrusions 160. When fuse carrier 28 is fully opened as shown in FIG. 8, arm 161 contacts a top surface 164 of bock 154 biasing block 154 downward against the bias of spring 156. It will be appreciated that arm 161 is configured to break the neutral circuit before the circuit carrying fuse 80 is broken when opening fuse carrier 28 from a closed position.

To close fuse carrier 28 with fuse 80 inserted therein, fuse carrier 28 is pivoted clockwise about a pin (not shown) inserted in aperture 82. When fuse carrier 28 is pivoted in a clockwise direction, arm 161 is tapered to allow bock to move upward under action of spring 156 as arm 161 is pivoted away limiting contact with block 154. Further clockwise pivoting of fuse carrier 28 allows block 154 to translate upward, thereby making the electrical connection between top surface of plate 158 and protrusions 160. When fuse carrier 28 is fully closed as shown in FIG. 5, arm 161 no longer contacts top surface 164 of bock 154 biasing block 154 downward against the bias of spring 156 and fuse 80 is electrically connected with contacts 64, 66.

Fuse holder 24 provides the flexibility of achieving a single pole fuse holder with and without neutral connection terminals utilizing the same base and cover, while only changing the cage holders to add or delete a neutral connection terminal. By using the same base and cover for both types of single pole configurations, costs associated with tooling and inventory are reduced. It will be appreciated that the present disclosure is not limited to single pole fuse holders and may be utilized with multiple pole fuse holders. For example, three fuse holders may be stacked to form a three-phase fuse device.

The fuse holder of the present disclosure is also suitable for use with miniature circuit breakers (MCB's), residual current circuit breakers (RCCB's), switches, and the like. Furthermore, by using individual separable cage holders as electrical terminal nodes within the fuse holder housing instead of fixing terminals directly to the housing, i.e., the base and cover, the cage holder can be separately configured to requisite properties for a specific application. For instance, a cage holder may be formed from a material to provide high strength and heat resistance at the terminals to protect the integrity of the fuse holder.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A fuse holder comprising:

a housing defining an enclosed region, said housing comprises a base and a cover, said base and said cover adapted to accept differently configured cage holders within said enclosed region;

a pair of contacts within said housing at opposite ends of said enclosed region and spaced to engage terminals on ends of a fuse; and a cage holder configured to fit within in said housing, said cage holder configured to include one of a single pole cage and a plurality of pole cages of different poles.

2. The fuse holder of claim 1 wherein said housing comprises a fuse carrier pivotally mounted on said housing, said fuse carrier is movable between a closed position, in which said pair of contacts electrically engage said terminals, and an open position, in which said fuse can be inserted into said fuse carrier.

3. The fuse holder of claim 1 wherein one pole cage of said plurality of pole cages is a neutral connection terminal and another pole cage of said plurality of pole cages is electrically connected to said pair of contacts.

4. The fuse holder of clam 1 wherein said single pole cage is electrically connected to said contacts.

5. The fuse holder of claim 1 wherein said single pole cage and at least one pole cage in said plurality of poles cages comprises: four generally planar sides with a flange extending generally perpendicularly from an edge forming one of said planar sides, and a screw threadably engaged with a side opposite said one of said planar sides for retaining an electrical wire entering an interior portion formed by said planar sides.

6. The fuse holder of claim 1 wherein said housing includes:

a pair of cavities disposed at opposing ends of said enclosed region, each cavity configured to receive said each cage holder;

a pair of apertures, each aperture of said pair of apertures is disposed above said each cavity and configured to receive a top surface edge of said cage holder; and a pair of openings, each opening of said pair of openings is disposed at said opposing ends and configured to receive a front face edge of said cage holder.

7. The fuse holder of claim 1 wherein said cage holder comprises a first half section and a complementary second half section, said first half section and said complementary second half section configured to retain said single pole cage therebetween.

8. The fuse holder of claim 1 wherein said each cage holder comprises:

a front face having a plurality of cutouts;

a rear face generally parallel to said front face having a slot generally aligned with each cutout of said plurality of cutouts; and a dividing face disposed intermediate said front face and said rear face generally extending perpendicular therebetween, said dividing face providing a cavity having said one cutout of said plurality of cutouts on each side of said dividing face, said cavity retaining a pole cage of said plurality of pole cages aligned with said each cutout.

9. The fuse holder of claim 1 wherein said base and said cover are configured with a defined channel to retain a neutral strap in said enclosed region.

10. The fuse holder of claim 9 wherein said defined channel includes a first and a second neutral strap disposed therein having a biased contact conducting plate intermediate said first neutral strap and said second neutral strap, said conducting plate biased to provide an electrical connection between said first neutral strap and said second neutral strap.

* * * * *